United States Patent [19]

Ernohazy et al.

[11] 4,122,473

[45] Oct. 24, 1978

[54] DEVELOPER RESIDUE WASTE ELIMINATOR FOR DIAZO MACHINES

[75] Inventors: Stephen Ernohazy, Mt. Prospect; Larry Allen Songer, Schaumburg; Thomas Vernon DeRyke, Libertyville; Eugene Peter Oddo, Mt. Prospect, all of Ill.

[73] Assignee: Addressograph-Multigraph Corporation, Los Angeles, Calif.

[21] Appl. No.: 700,408

[22] Filed: Jun. 28, 1976

[51] Int. Cl.[2] ..... G03D 7/00

[52] U.S. Cl. ..... 354/299; 354/300; 55/70; 96/49; 34/73

[58] Field of Search ..... 354/299, 300; 55/70, 55/80; 219/271; 96/49; 34/73, 78, 79, 155

[56] References Cited

U.S. PATENT DOCUMENTS

| | | | |
|---|---|---|---|
| 2,761,364 | 9/1956 | Cross | 354/300 |
| 3,147,687 | 9/1964 | Halden | 354/300 |
| 3,836,987 | 9/1974 | Gibbons et al. | 55/70 |
| 3,969,741 | 7/1976 | Frank et al. | 354/300 |
| 3,982,258 | 9/1976 | Czebiniak | 354/300 |
| 4,003,069 | 1/1977 | Hilgers | 354/300 |

FOREIGN PATENT DOCUMENTS

| | | | |
|---|---|---|---|
| 2,337,961 | 2/1975 | Fed. Rep. of Germany | 354/300 |
| 2,402,286 | 7/1975 | Fed. Rep. of Germany | 354/300 |
| 2,364,460 | 3/1975 | Fed. Rep. of Germany | 354/300 |
| 2,225,776 | 8/1974 | France | 354/300 |
| 1,365,759 | 9/1974 | United Kingdom | 354/300 |

*Primary Examiner*—L. T. Nix
*Assistant Examiner*—Alan Mathews
*Attorney, Agent, or Firm*—Michael A. Kondzella

[57] ABSTRACT

The present invention provides a device for eliminating the residue waste of aqueous ammonia solution, comprising a first portion of ammonia gas and a second portion of steam, of a developer system in an ammonia type diazo machine. The device provides for separating the first and second portions, recirculating the first portion to the developer system, condensing the second portion to form water and conveying the water via an inlet duct to an evaporator tank. A heater is provided for heating the evaporator tank to vaporize the water therein and an outlet duct is provided for expelling the water vaporized in the tank to an exhaust system of the machine. The heater is controlled by a first thermostat for maintaining the temperature in the evaporator tank within a working range to vaporize the water, and a second thermostat is provided for sensing a temperature below the working range indicating a heater failure and, in response thereto, initiating stoppage of residue waste flow from the developer system to prevent overflow of water in the evaporator tank.

12 Claims, 3 Drawing Figures

DEVELOPER RESIDUE WASTE ELIMINATOR FOR DIAZO MACHINES

BACKGROUND OF THE INVENTION

In the ammonia developing process an excess of ammonium hydroxide is introduced into the developer system to provide a hot, moist alkaline environment. In a conventional ammonia type diazo machine the residue waste of aqueous ammonia solution is drained from the developer system to a waste collection container and the container is periodically emptied. To eliminate this inconvenient and undesirable procedure, and to avoid escape of ammonia gas or fumes to the atmosphere, the present invention provides a convenient and safe arrangement for eliminating the residue waste without the need of emptying the waste container and without requiring intervention by the machine operator in any way.

SUMMARY OF THE INVENTION

The invention relates to a liquid developer residue waste eliminator device for use with ammonia type diazo machines which may be installed on existing copying machines without requiring major modification thereof.

The device comprises separator means for separating the residue waste of aqueous ammonia from the developer system into a first portion of ammonia gas and a second portion of steam. The first portion is recirculated to the developer system and the second portion is condensed, to form substantially pure water, and conveyed by an inlet duct means to an evaporator tank.

The device includes a heater unit for heating the tank to an elevated temperature for vaporizing the water in the tank, a first thermostat for controlling the heater unit to maintain the vaporizing temperature within a working range, a second thermostat for sensing a temperature below the working range indicating a heater malfunction, inlet duct means for directing the water flow to the tank, a tube orifice associated with the inlet duct means and the tank to prevent the vaporized waste from being conveyed from the tank to the developer system and an outlet duct means for expelling the vaporized waste, in the form of steam, to an exhaust system of the copying machine.

The residue waste issuing from the developer system travels to a separator means whereat the first portion is recirculated to the developer system and the second portion is condensed and is conveyed by the inlet duct means to the bottom of the evaporator tank. The heater, under control of the first thermostat, vaporizes the water in the tank and the vapor, or hot steam is drawn from the tank through the outlet duct means to the exhaust system. In the event of a heater failure, detected by the second thermostat sensing a temperature below the working range, a machine cool-down cycle is initiated to arrest ammonia flow from a supply source to the developer system, and to arrest residue waste flow from the developer system to prevent overflow of water in the evaporator tank.

An object of the invention is to provide a device for eliminating liquid developer residue waste in an ammonia type diazo machine which is convenient and safe in operation. The device provides a closed system which precludes exposure of undesirable ammonia residue waste fumes to the atmosphere.

Another object is to provide a residue waste eliminator device for separating the ammonia gas from the water vapor of the residue waste, recirculating the ammonia to the developer system, condensing the vapor to form water, vaporizing the water to form steam and expelling the steam to an exhaust system of the machine without requiring machine operator intervention in the way of periodically emptying a residue waste container as associated with conventional systems.

Another object is to provide a heater unit for vaporizing the water supplied to the evaporator tank including a first thermostat to maintain the temperature within a proper working range for vaporizing the water, and a second thermostat to prevent overflow of the water in the tank in the event of and in response to detection of a malfunction of the heater unit.

A feature of the invention is to provide a residue waste eliminator device which is compact and inexpensive to produce.

Other objects, features and advantages of the invention will appear hereinafter as the description proceeds.

IN THE DRAWING

DESCRIPTION OF THE PREFERRED EMBODIMENT

Figure 1:
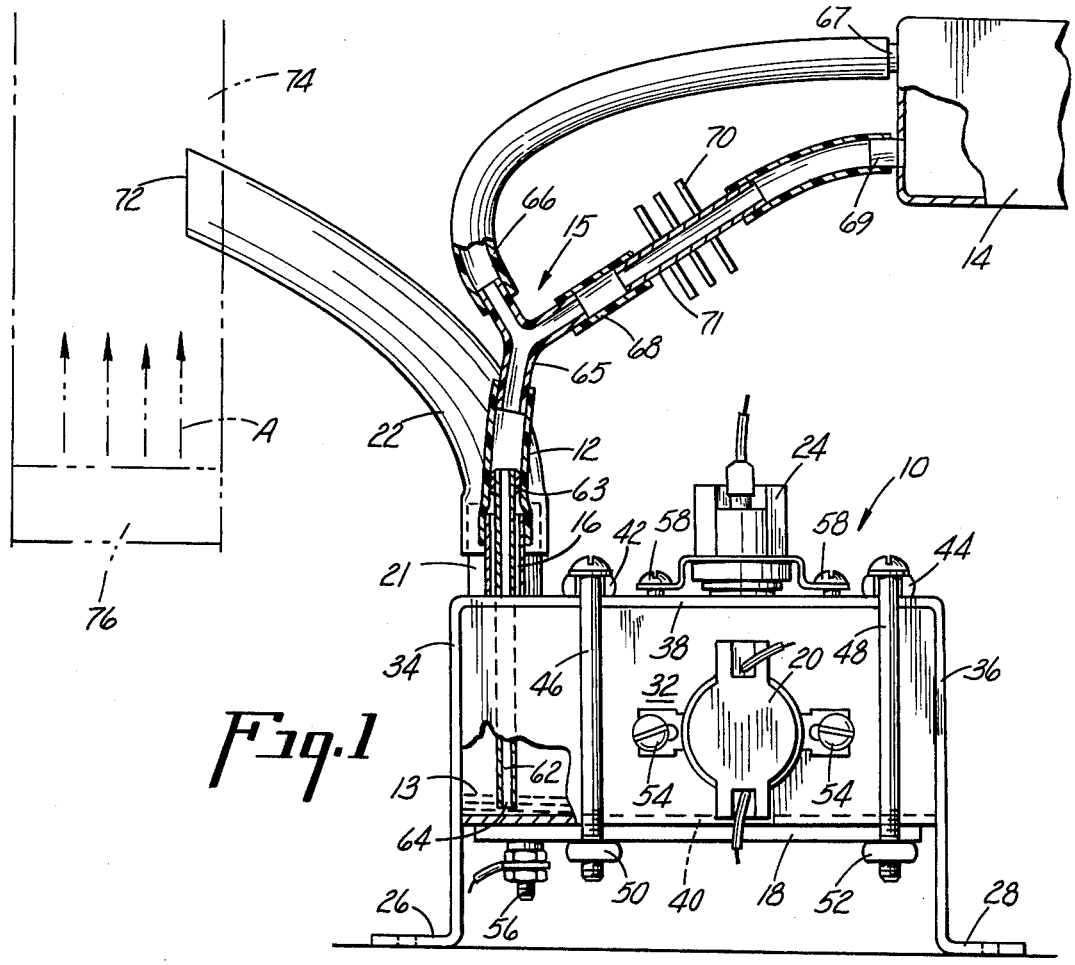
FIG. 1 is a front elevation of a liquid developer residue waste eliminator device, partially in section, in association with a developer system and an exhaust system of an ammonia type diazo machine in accordance with the present invention.

As shown in FIG. 1, the liquid residue waste eliminator device comprises an evaporator tank indicated generally by the reference numeral 10. An inlet duct 12 extends from an ammonia developer system 14 of a diazo copying machine to a residue waste separating station indicated at 15 and from there to an inlet duct connector 16 on the tank 10. The residue waste includes a first portion of ammonia gas and a second portion of water vapor or steam. At the separating station 15, the first portion is recirculated to the developer system 14 and the second portion is condensed and conveyed by the inlet duct 12 to the tank 10 where it settles in the form of water 13 at the bottom of the tank, as will be further described hereinafter.

A heater unit 18 is provided at the bottom of the tank 10 and, under control of a first thermostat 20, heats the evaporator tank 10 to an elevated temperature to vaporize the water in the tank. As the second portion of residue waste 13, which is substantially pure water, enters the tank from the inlet duct 12, the heater unit 18 is effective to vaporize the water and the hot steam resulting from vaporization of the water is expelled from the tank 10 through an outlet duct 22 extending from an outlet duct 21 on the tank to an exhaust system of the copying machine.

A second or safety thermostat 24 is provided and, in the event of a heater failure, the thermostat 24 detects the lower temperature and initiates a machine cool-down cycle which arrests ammonia flow to the developer system 14 and liquid residue waste flow from the developer system to prevent overflow of the water in the evaporator tank.

Figure 2:
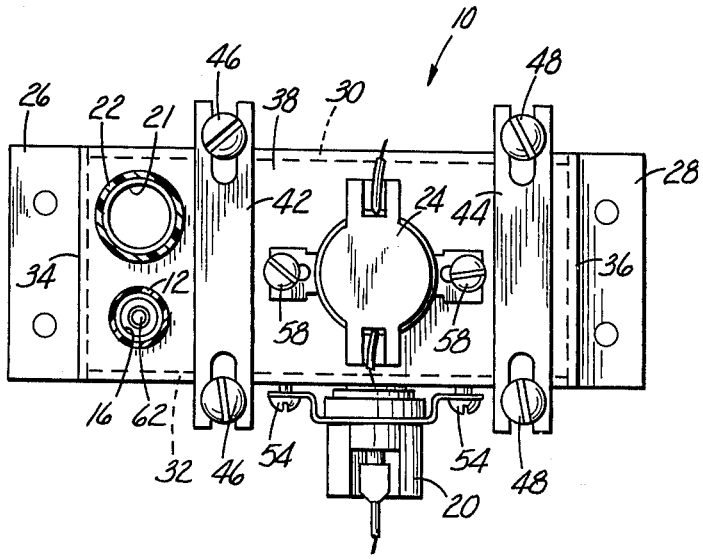
FIG. 2 is a plan view of the device.

With reference to FIG. 2, the evaporator tank 10 may be constructed in any suitable manner to provide side walls 30 and 32, end walls 34 and 36 terminating in a leg 26 and 28 respectively, a top 38 and a bottom 40. Preferably, the tank 10 is of welded construction to provide a sealed enclosure to prevent leakage of the water 13. Also, the evaporator 10 and the connectors 16 and 21 are of stainless steel or other suitable material which is impervious to attack by chemically reactive liquid such as ammonia.

The heater unit 18 is a 300 watt electrically heated plate mounted in contact with the outer surface of the bottom 40 of the evaporator tank 10. The heater unit is mounted to the tank with a pair of straps 42 and 44 positioned on the top 38 of the tank, and a pair of bolts 46 and a pair of bolts 48 extending from the straps 42 and 44 respectively, and threaded into nut-bars 50 and 52 respectively, positioned at the bottom of the heater unit 18.

The thermostat 20 is mounted on the side wall 32 with fastening means 54 and controls and maintains the temperature at a proper working range for vaporizing the water in the evaporator tank 10. The thermostat 20 is connected between a terminal 56 on the heater unit 18 and one side of a main of an electrical circuit. The thermostat 20 is operable to maintain the vaporizing temperature in the evaporator tank 10 within a working range of about 200° F. – 250° F. Without a control for the heater unit 18, the heater unit could produce a temperature output as high as 500° F. – 600° F. Therefore, the thermostat 20 is designed to operate such that it opens at 250° F. to thereby prevent excessive heat build-up of the heater unit and possible damage to the device. Also, the thermostat is operable to close a 200° F. to maintain the temperature in the evaporator tank 10 within a working range and to prevent the temperature from dropping to a low level which would be insufficient to vaporize the water in the evaporator tank.

The safety thermostat 24 is mounted on the top 38 of the evaporator tank 10 with fastening means 58 and, as explained above, is effective to initiate arrestment of residue waste flow from the developer system 14 in the event of a heater failure. The thermostat 24 is connected to a terminal 60 (FIG. 3) on the heater unit 18 and from there to the other side of the main of the electrical circuit. The thermostat 24 is operable within a range of about 140° F. – 170° F. In the event of a heater failure and the thermostat 24 detecting a temperature below the working range, at 140° F. the thermostat 24 is operable to a closed condition which initiates a machine cool-down cycle, discontinues ammonia flow to the developer system 14 and arrests residue waste flow from the developer system. This arrangement prevents the possibility of the water overflowing the evaporator tank 10.

Figure 3:
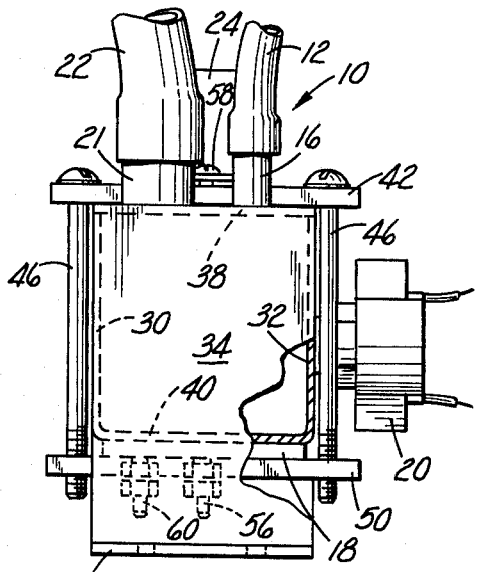
FIG. 3 is an end elevation of the device, partially in section, as viewed from the left in FIG. 1.

With reference to FIGS. 1 and 3, the device further includes a tube orifice 62 extending from an end 64 positioned below the level of the water 13 at the bottom of the evaporator tank 10, upwardly through the connector 16 and into the inlet duct 12 whereat it is retained by a ferrule 63. The tube orifice 62 is also made of stainless steel or other suitable material impervious to attack by chemically reactive liquids such as ammonia. To insure that the end 64 of the tube orifice 62 is maintained below the level of the water in the evaporator tank, to prevent flow of the vaporized water from the evaporator tank through the tube orifice 62 to the developer system 14, the end wall 36 is preferably made somewhat longer than the end wall 34 so that the evaporator tank 10, when mounted in an operative position on the legs 26 and 28, is positioned at a slight angle as shown in FIG. 1 to cause the water 13 to flow towards the tube orifice 62.

From the tube orifice 62, the inlet duct 12 extends upwardly to the separator station 15 comprising a "Y" connection 65 and then branches into a first branch conduit 66 connected to a residue waste exit 67 of the developer system 14, and a second branch conduit 68 connected to an ammonia inlet 69 of the developer system. The branch 68 is provided with a connector 71 associated with a heat sink 70 for trapping and condensing steam in the branch 68 to allow the ammonia gas free passage back to the developer system 14 as will be further described hereinbelow.

The outlet duct 22 extends from the connector 21 on the evaporator tank 10 and terminates in an end 72 in a duct air-flow 74 of the exhaust system of the machine as shown schematically and in phantom in FIG. 1. The end 72 of the outlet duct 22 is bias cut and exposes a large area of the inside diameter of the duct 22 to a high velocity air flow, in a direction parallel to the bias cut of the end 72 as shown by the arrows A. The high velocity air flow is provided by a blower 76. This arrangement results in a low pressure area in the duct air-flow 74 and, subsequently, in a low pressure within the outlet duct 22. The low pressure area assists in withdrawing the vaporized residue waste, which has been vaporized to form steam, from the evaporator tank 10 to the exhaust system.

A description of the operation of the device will now be given. The liquid residue waste issuing from the exit 67 of the developer system 14 into the branch 66 is a combination of a first portion of ammonia gas and a second portion of steam having a temperature of about 220° F. – 230° F. The residue waste comprising the ammonia gas and the steam traverses the branch 66 and moves down to the junction of the "Y" connection 65, whereat it has two possible paths it can take. However, because both the ammonia gas and the steam are light and are seeking a low pressure area, from the "Y" junction they are caused to traverse up the opposite branch 68.

The ammonia gas which traverses up the branch 68 is allowed free passage by the heat sink 70 and returns to the inlet 69. The steam which traverses up the branch 68, however, is cooled and condensed by the heat sink 70 and flows down the inlet duct 12 to the bottom of the evaporator tank 10. Hence the residue waste entering the evaporator tank 10 is almost pure heated water containing little or no ammonia. The water is vaporized in the evaporator tank to form steam which creates a higher pressure in the evaporator tank. Because the end 64 of the tube orifice 62 is positioned below the level of the water 13 in the tank 10, this higher pressure within the tank is not carried upwardly into the duct 12 and into the developer system 14. The higher pressure within the evaporator tank 10 in combination with the lower pressure generated by the duct air-flow 74, as described above are effective to expel the residue waste in the form of steam from the tank to the exhaust system. Accordingly, there is no discharge or leakage of ammonia gas, fumes or the like to the exhaust system or to the atmosphere because the residue waste vaporized in the evaporator tank 10 and expelled to the exhaust system is almost entirely steam from the condensed water in the branch 68. The ammonia in the branches 66 and 68 is recirculated into the developer system 14 and does not reach the exhaust system.

From the foregoing, it will be appreciated that the present invention provides a device for eliminating developer liquid residue waste in an ammonia type diazo copying machine in a safe and convenient manner. The device is effective to separate ammonia from steam, condense the steam to form water, vaporize the water to form steam, expel the steam to an exhaust system and to recirculate ammonia into the developer system. Thus, there is no requirement for machine operator intervention in the way of periodically emptying a residue waste container as associated with conventional residue waste collectors of ammonia type diazo copying machines.

What is claimed is:

1. A device for eliminating gaseous developer residue waste from a developer system of an ammonia type diazo copying machine, in which the gaseous residue waste includes a first portion of ammonia gas and a second portion of steam, comprising:

inlet duct means for receiving gaseous residue waste from the developer system of the copying machine;

heat sink means associated with the inlet duct means for separating the first and second portions of gaseous residue waste by converting the second portion to liquid;

evaporator means for receiving the liquid;

heater means for heating the evaporator means to an elevated temperature to vaporize the liquid therein; and orifice means extending from a position below the level of the liquid in the evaporator means to the inlet duct means to prevent flow of the vaporized liquid from the evaporator means to the developer system.

2. A device for eliminating gaseous developer residue waste from a developer system of an ammonia type diazo copying machine, in which the gaseous residue waste includes a first portion of ammonia gas and a second portion of steam, comprising:

a first branch conduit in communciation with a gaseous residue waste exit of the developer system;

a second branch conduit in communication with the first branch conduit and the developer system;

heat sink means associated with the second branch conduit for separating the first and second portions of gaseous residue waste by converting the second portion to liquid;

inlet duct means in communication with the first and second branch conduits for conveying the liquid to an evaporator means;

heater means for heating the evaporator means to an elevated temperature to vaporize the liquid therein; and orifice means extending from a position below the level of the liquid in the evaporator means to the inlet duct means to prevent flow of the vaporized liquid from the evaporator means to the developer system.

3. A device as set forth in claim 2 in which the second branch conduit is in communication with an inlet of the developer system for recirculating the first portion from the heat sink means to the developer system.

4. A device as set forth in claim 2 further comprising a first thermostat for controlling the heater means for maintaining the vaporizing temperature within a working range.

5. A device as set forth in claim 2 further comprising outlet means for expelling the second portion vaporized by the evaporator means to an exhaust system of the copying machine.

6. A device as set forth in claim 4 in which the working range is about 200° F. - 250° F.

7. A device as set forth in claim 5 in which the outlet means comprises:

an outlet duct extending from the evaporator means and terminating in a bias cut end in a duct air-flow of the exhaust system; and blower means producing a high velocity air-flow in a direction parallel to the bias cut end of the outlet duct to create a low pressure area in the duct air-flow and within the outlet duct.

8. A method of eliminating gaseous developer residue waste comprising a first portion of ammonia gas and a second portion of steam from a developer system of an ammonia type diazo copying machine, which comprises the steps of:

separating the first and second portions of gaseous residue waste by converting the second portion to liquid;

recirculating the first portion to the developer system;

vaporizing the liquid by heating the liquid to an elevated temperature while preventing recirculation of the vaporized liquid to the developer system; and expelling the vaporized liquid.

9. A method as set forth in claim 8 comprising the further step of controlling the heating to maintain the vaporizing temperature within a working range.

10. A device for eliminating gaseous developer residue waste from a developer system of an ammonia type diazo copying machine, in which the gaseous residue waste includes a first portion of ammonia gas and a second portion of steam, comprising:

a first branch conduit in communication with a gaseous residue waste exit of the developer system;

a second branch conduit in communication with the first branch conduit and the developer system;

heat sink means associated with the second branch conduit for separating the first and second portions of gaseous residue waste by converting the second portion to liquid;

inlet duct means in communication with the first and second branch conduits for conveying the liquid to an evaporator means;

heater means for heating the evaporator means to an elevated temperature to vaporize the liquid therein;

a first thermostat for controlling the heater means for maintaining the vaporizing temperature within a working range; and a second thermostat for arresting flow of gaseous residue waste from the developer system in response to detecting a temperature below the working range.

11. A device for eliminating gaseous developer residue waste from a developer system of an ammonia type diazo copying machine, in which the gaseous residue waste includes a first portion of ammonia gas and a second portion of steam, comprising:

a first branch conduit in communication with a gaseous residue waste exit of the developer system;

a second branch conduit in communication with the first branch conduit and the developer system;

heat sink means associated with the second branch conduit for separating the first and second portions of gaseous residue waste by converting the second portion to liquid;

inlet duct means in communication with the first and second branch conduits for conveying the liquid to an evaporator means;

heater means for heating the evaporator means to an elevated temperature to vaporize the liquid therein;

a first thermostat for controlling the heater means for maintaining the vaporizing temperature within a working range; and a second thermostat for arresting flow of gaseous residue waste from the developer system in response to detecting a temperature below the working range;

said second thermostat being operable in a temperature range of about 140° F. – 170° F.;

whereby flow of the liquid to the evaporator means is arrested in response to the second thermostat detecting a temperature of 140° F. or less to prevent overflow of the liquid in the evaporator means.

12. A method of eliminating gaseous developer residue waste comprising a first portion of ammonia gas and a second portion of steam from a developer system of an ammonia type diazo copying machine, which comprises the steps of;

separating the first and second portions of gaseous residue waste by converting the second portion to liquid;

heating the liquid to an elevated temperature to vaporize the liquid;

controlling the heating to maintain the vaporizing temperature within a working range; and arresting flow of gaseous residue waste from the developer system in response to detecting a temperature below the working range.

* * * * *